US006558201B1

(12) United States Patent
Begley et al.

(10) Patent No.: US 6,558,201 B1
(45) Date of Patent: May 6, 2003

(54) ADAPTER AND METHOD FOR CONVERTING DATA INTERFACE HARDWARE ON A COMPUTER PERIPHERAL DEVICE

(75) Inventors: Paul V Begley, Loveland, CO (US); Gregory A Standiford, Loveland, CO (US)

(73) Assignee: Hewlett Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/420,993

(22) Filed: Oct. 20, 1999

(51) Int. Cl.[7] ..... H01R 25/00
(52) U.S. Cl. ..... 439/638; 439/955
(58) Field of Search ..... 439/488, 638, 439/955; 710/129, 131

(56) References Cited

U.S. PATENT DOCUMENTS 4,936,785 A 6/1990 Krug et al.
5,030,128 A * 7/1991 Herron et al. ..... 439/372
5,040,993 A 8/1991 Krug et al.
5,290,178 A * 3/1994 Ma ..... 439/652
5,411,416 A * 5/1995 Balon et al. ..... 439/639
5,457,785 A * 10/1995 Kikinis et al. ..... 395/308
5,475,818 A * 12/1995 Molyneaux et al. ... 395/200.05
5,530,895 A * 6/1996 Enstrom ..... 395/829
5,545,057 A * 8/1996 Tan et al. ..... 439/540
5,555,510 A * 9/1996 Verseput et al. ..... 364/514 R
5,567,180 A * 10/1996 Seo ..... 439/638
5,569,052 A * 10/1996 Belt et al. ..... 439/638
5,615,344 A * 3/1997 Corder ..... 395/309
5,729,478 A * 3/1998 Ma et al. ..... 364/708
5,741,151 A * 4/1998 Youngers ..... 439/489
5,779,499 A * 7/1998 Sette et al. ..... 439/540
5,816,859 A * 10/1998 Dubin et al. ..... 439/638
5,832,244 A * 11/1998 Jolley et al. ..... 395/309
5,947,748 A * 9/1999 Licht et al. ..... 439/59
5,948,077 A * 9/1999 Choi et al. ..... 710/9
6,070,214 A * 5/2000 Ahern ..... 710/128
6,139,342 A * 10/2000 Thompson ..... 439/188
6,144,561 A * 11/2000 Cannella, Jr. et al. ..... 361/796
6,219,732 B1 * 4/2001 Henrie et al. ..... 710/102
6,321,340 B1 * 11/2001 Shin et al. ..... 713/310
6,358,204 B1 * 3/2002 Finger et al. ..... 600/437

* cited by examiner

*Primary Examiner*—Tulsidas Patel
*Assistant Examiner*—Thanh-Tam Le

(57) ABSTRACT

An adapter and method for converting the data interface hardware of a computer peripheral device. A set of connectors is arranged to mate with the interface conductors of a computer peripheral device that contains the circuitry and firmware necessary to support the use of more than one computer peripheral data interface. Another set of connectors is provided to connect with the interfaces being used by a computer. An indication to the device of which of the supported data interfaces is to be used is provided.

20 Claims, 5 Drawing Sheets

ADAPTER AND METHOD FOR CONVERTING DATA INTERFACE HARDWARE ON A COMPUTER PERIPHERAL DEVICE

FIELD OF THE INVENTION

This invention relates, in general, to interface adapters for computer peripheral devices, and, more specifically, to an interface adapter that converts the type of data interface utilized by a computer peripheral device to communicate with a computer.

BACKGROUND OF THE INVENTION

Computers utilize computer peripheral devices, such as optical disk drives, magnetic tape drives, and compact disc read only memory (CDROM) drives, for secondary data storage and retrieval, as well as for other myriad uses. In order for computers to utilize such devices, the computer and the associated device must be capable of communicating in some fashion to allow the device to perform the functions requested of it by the computer. This communication is normally embodied in a standardized set of hardware components, signal protocols and software commands, which are collectively termed a "computer peripheral data interface". The physical portion of the interface typically consists of an multi-conductor cable with connectors on each end, and the appropriate circuitry on the computer and peripheral device to allow electrical signals to be transmitted and received over the cable. Several such data interfaces commonly employed today include, for example, the Small Computer System Interface (SCSI), the AT Attachment (ATA) interface, and the Universal Serial Bus (USB). Even within each type of computer peripheral interface, several different variations of those interfaces can exist, as can be witnessed by the assorted configurations of SCSI available, such as Fast SCSI, Fast Wide SCSI, Ultra SCSI, and the like.

Some computer peripheral devices require the use of one or more interfaces aside from the main data interface. For example, CDROM drives generally employ an audio interface, which often is connected via a cable to a sound card resident in a computer. Additionally, power is usually supplied to the drive by way of yet another cable.

Some differences in data interfaces relate primarily to the mechanical configuration of the connectors and cables involved with the interface. For example, RS-232C-based serial interfaces exist in a multitude of mechanical configurations, and conversion between the various types is normally accomplished by way of a simple adapter, such as a pin-to-socket type converter. Another example of a related type of adapter for peripheral devices may be found in U.S. Pat. Nos. 4,936,785 and 5,040,993.

However, with the advent of the various types of computer peripheral data interfaces now available, each with a different hardware signal protocol and software command set, such as those mentioned above, providing more than one interface on a peripheral device has become more problematic due to the substantially different hardware and firmware requirements for each data interface.

The computer peripheral data interface chosen by a user for a particular combination of computer and peripheral device depends on a few important factors. For instance, the physical placement of the device in relation to the computer system is an important consumer consideration. A computer peripheral device that is manufactured specifically to reside within the main computer case is usually termed an "internal" device. Conversely, a device that is designed to reside outside of the computer in a separate housing is known as an "external" device. Generally speaking, an external device will be more expensive than a comparable internal unit, due at least partially to the additional requirement for an external case and power supply. Obviously, an external device may occupy more desk space than a similar internal device, as well. However, in exchange for these disadvantages, an external device allows more portability than a related internal model, as the user would likely need to open the computer case to extract an internal device for use with another computer system.

Once the decision of using an external or internal device has been made, the number of possible computer peripheral data interfaces that may be used is typically narrowed. For example, the ATA interface is used almost exclusively in internal configurations, USB is primarily employed as an external interface, and SCSI, depending on the hardware utilized, can be used in either an internal or external configuration.

The "internal versus external" choice also affects the physical configuration of other interfaces employed by the device. More specifically, the audio connector of a CDROM drive tends to be different for an external drive unit when compared to its internal counterpart. Also, the connection for power delivery from a computer to an internal drive unit is usually quite different from that of a normal external power supply utilized by external, portable devices.

Parameters other than system configuration, such as price and performance, also have an effect on the choice of computer peripheral data interface. As an example, SCSI configurations generally cost more and provide higher performance than ATA systems. Such considerations further influence the data interface choice of most users.

Therefore, with such data interface options available to the consumer, it is often in the best interests of the peripheral device manufacturers to provide as many of the more popular data interfaces for each type of device they sell as is economically feasible. For example, a CDROM drive manufacturer may want to sell both an ATA and a SCSI version of their drive in order to broaden the appeal of their product.

Unfortunately, producing multiple versions of a peripheral device, one for each type of computer peripheral data interface, is usually rather expensive, both for the manufacturer and the consumer. Generally, manufacturers employ either of two methods to address the issue. One method involves making a single version of the drive capable of supporting one standard data interface, and then adding an "interface converter", consisting of a relatively expensive printed circuit board with a set of connectors that mate with the interface connectors of the device, and another set of connectors for interfaces employed by the computer. The interface converter, which usually resides outside of the chassis of the peripheral device, may be housed in a separate case, or in an expanded case along with the device. The expense of the interface converter is due primarily to the amount of circuitry that would be necessary to translate the signal protocols and software commands of the interface on the computer side of the converter to those associated with the "native," or preexisting, interface of the device. One interface converter is needed for each type of data interface to be supported other than the native interface.

The second method commonly employed by device manufacturers when providing more than one interface for a particular product is to actually make separate main printed circuit boards for the device, one to provide the hardware and embedded software (or "firmware") for each interface to be supported. Although this approach eliminates the problem of requiring the user to buy a separate converter, other problems arise, specifically with respect to manufacturing, testing and inventory control. Instead of manufacturing and testing one device, which would require just one manufacturing and testing line, a separate line would be required for each supported interface, just as if the various data interface versions of the drive were each completely separate products. Inventory control also becomes problematic, as the quantity in inventory of the various components of the device that differentiate the multiple data interface versions should, to a certain degree, reflect the number of each type of device to be sold in the future. Such quantities have been difficult historically to predict.

Accordingly, there exists a need for a simple and cost-effective means to connect a computer peripheral device to a computer by way of more than one computer peripheral data interface.

SUMMARY OF THE INVENTION

In a possible embodiment, the invention provides a simple interface adapter that allows the conversion of the data interface hardware of a computer peripheral device. Such an adapter permits the manufacturing of a single type of peripheral device, thereby simplifying the manufacturing, testing, and inventory control of the device. Furthermore, the adapter does not require the space or expense of typical interface converters.

The adapter, as a possible embodiment of the invention, provides a means to physically connect a computer to a computer peripheral device that contains the circuitry and associated firmware necessary to communicate via all data interfaces that the manufacturer of the device wishes to provide. This capability has become more prevalent in recent years, as advances in integrated circuit technology allow more functionality to occupy less space on a printed circuit board. Due to these advances, manufacturers of integrated circuits that implement a portion of the data interface are now able to implement more than one such data interface within a single IC package, with the interfaces usually being multiplexed on the same signal lines.

In addition to the actual physical connector conversions required, the adapter also provides a means for indicating to the peripheral device which of the supported interfaces is to be used when communicating with the computer. In an example embodiment, the indication of the interface to be utilized is accomplished by a simple electrical conductor connecting two interface conductors of the device. The device may then, using any appropriate hardware and firmware necessary, reconfigure the internal circuitry of the device to use the indicated data interface.

In some cases, the computer peripheral device provides a connector for only one of the supported data interfaces. A possible embodiment to address this situation involves an adapter that contains a connector that mates with the data interface connector on the device. The adapter would then also include a connector that allows connection with the cable for the data interface being used by the computer.

In another possible embodiment, the peripheral device would instead utilize a general-purpose connector not intended to connect to any specific peripheral interface. Alternately, the device could just provide a set of conductive pads on an edge of the main printed circuit board of the device. In either case, an example embodiment of the adapter would have an appropriate connector to interface with the general-purpose connector or conductive pads of the device, along with a connector for connection to the peripheral interface cable to be used.

In each case, other interfaces separate from the peripheral device data interface may also need to be converted from one physical configuration provided by the drive to another expected by the computer or other unit. For example, the audio and power interfaces of CDROM drives, mentioned above, tend to be different for external drives, as compared to their internal counterparts. Any physical conversion necessary for such interfaces from the device to the computer or another external unit are also accomplished by the invention in an example embodiment.

In another representative embodiment, the computer peripheral device contains connectors for all of the peripheral data interfaces supported by the device, but any other interfaces used by the device may still need to be converted to an alternate physical configuration, depending on, for example, whether the device is to be configured for internal or external operation. A possible embodiment of the invention in this case would be an adapter with audio and power connectors that mate with the corresponding connectors on the device, as well as a set of audio and power connectors that are compatible with those provided by cables connected to the computer.

In all of the preceding embodiments, the necessary connections between the connectors that mate with the device and those that mate with the various interfaces may be accomplished with simple wiring. Optionally, the connections may be made in some embodiments with traces on a small printed circuit board.

In yet another representative embodiment, the present invention may also be implemented as a method of providing the same type of connections afforded by the use of the adapter embodiments discussed above by allowing the electrical connection of the interface conductors located on the peripheral device to the cable connectors of the data interface employed by the associated computer, and supplying an indication to the device of the identity of the computer peripheral data interface to be used.

Other attributes and advantages of the invention will become apparent from the following detailed description and accompanying drawings, illustrating by way of example the principles of the invention.

DETAILED DESCRIPTION OF THE INVENTION

Figure 1:
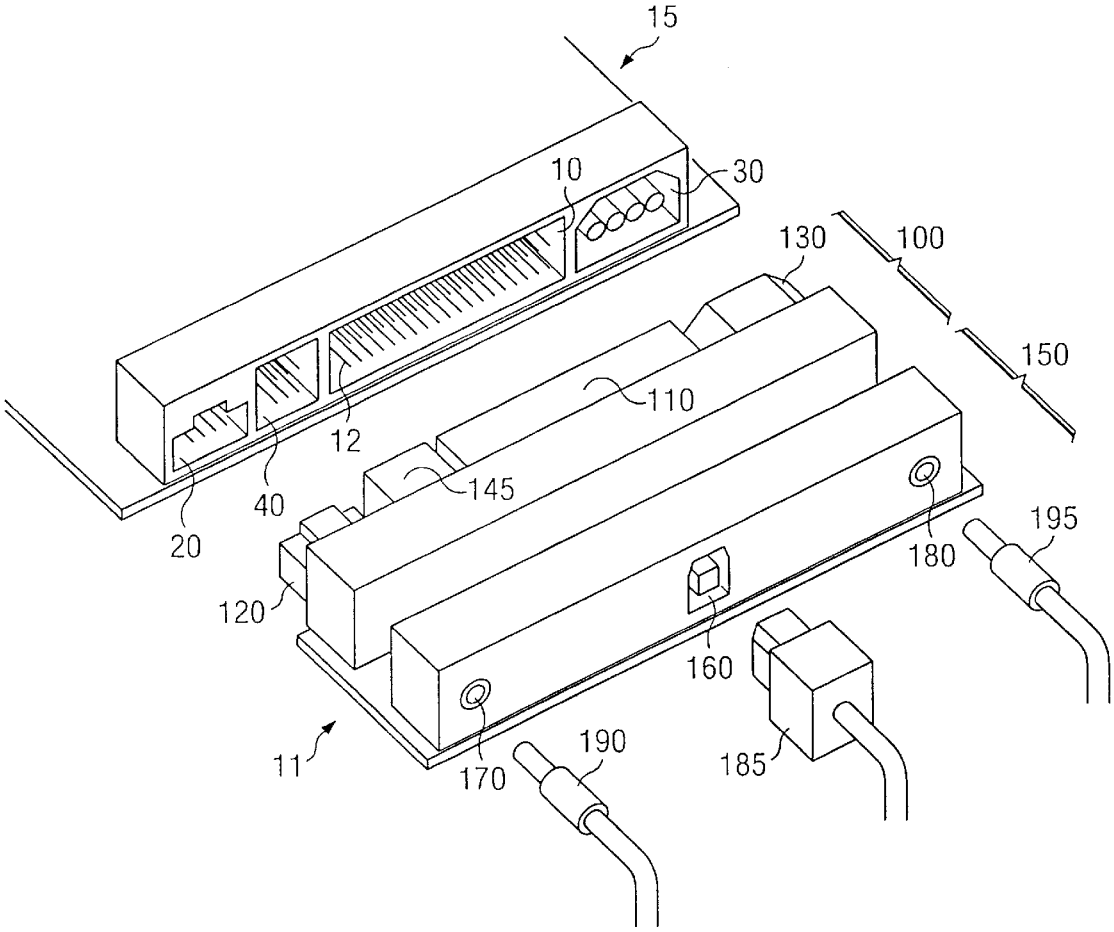
FIG. 1 is a perspective view of an adapter embodying the invention, shown in relation to a computer peripheral device employing a native data interface connector, wherein all physical interface connections of the device must be converted.

In the following description, as well as in the drawings, like elements are identified with like reference numerals.

A simple adapter according to a possible embodiment of the invention includes a converter 11 to physically connect interface conductors 12 of a computer peripheral device 15 to the conductors of an interface connector being used by a computer, and a means to indicate to the device which one of a number of supported data interfaces to use when communicating with the computer.

In an example system, the computer peripheral device is connected to a computer by one or more cables representing the various interfaces necessary for communication. For example, as shown in FIG. 1, a typical CDROM drive configured for internal use provides a 40-pin ATA data interface connector 10 for an ATAPI (ATA Packet Interface) ribbon cable connection with the computer, a 4-pin device audio connector 20 for interfacing with the sound card of the computer, and a 4-pin device power connector 30 for receiving power from the power supply of the computer. Also, a 6-pin configuration jumper block 40 is also used to allow the user to configure the ATAPI connection of the drive for the current computer system.

Presuming that the device possesses the control circuitry and associated firmware to readily utilize a USB connection, and an external configuration for the drive is desired, a representative embodiment of the adapter, which is also shown in FIG. 1, can be used which contains a set of device-side connectors 100 that attach directly to the connectors of the peripheral device. Electrical contacts of an ATA device connector 110 engage the corresponding interface contacts of the ATA data interface connector 10 on the device. Likewise, electrical contacts of an audio connector 120 connect with the signal contacts of device audio connector 20, electrical contacts of a power connector 130 engage the power contacts of device power connector 30 of the device, and electrical contacts of a device configuration connector 145 mate with the configuration contacts of configuration jumper block 40.

The electrical contacts of device-side connectors 100 that are necessary for implementing the USB data interface and the other associated audio and power interfaces are connected to appropriate contacts of a set of computer-side connecters 150 of the adapter. Signal contacts of a USB peripheral interface connector 160 are connected with corresponding electrical contacts of a USB computer peripheral data interface connector 185. In similar fashion, signal contacts of an audio interface connector 170 mate with electrical contacts of a computer peripheral audio interface connector 190, and power contacts of a power interface connector 180 engage electrical contacts of a computer peripheral power interface connector 195.

The necessary connections between the electrical contacts of device-side connectors 100 and the contacts of computer-side connectors 150 can be made by any number of methods. In a possible embodiment, the connections may be made by traces on a printed circuit board upon which all of the connectors reside. In another embodiment, all of the necessary connections could be made with flexible wires.

Figure 2:
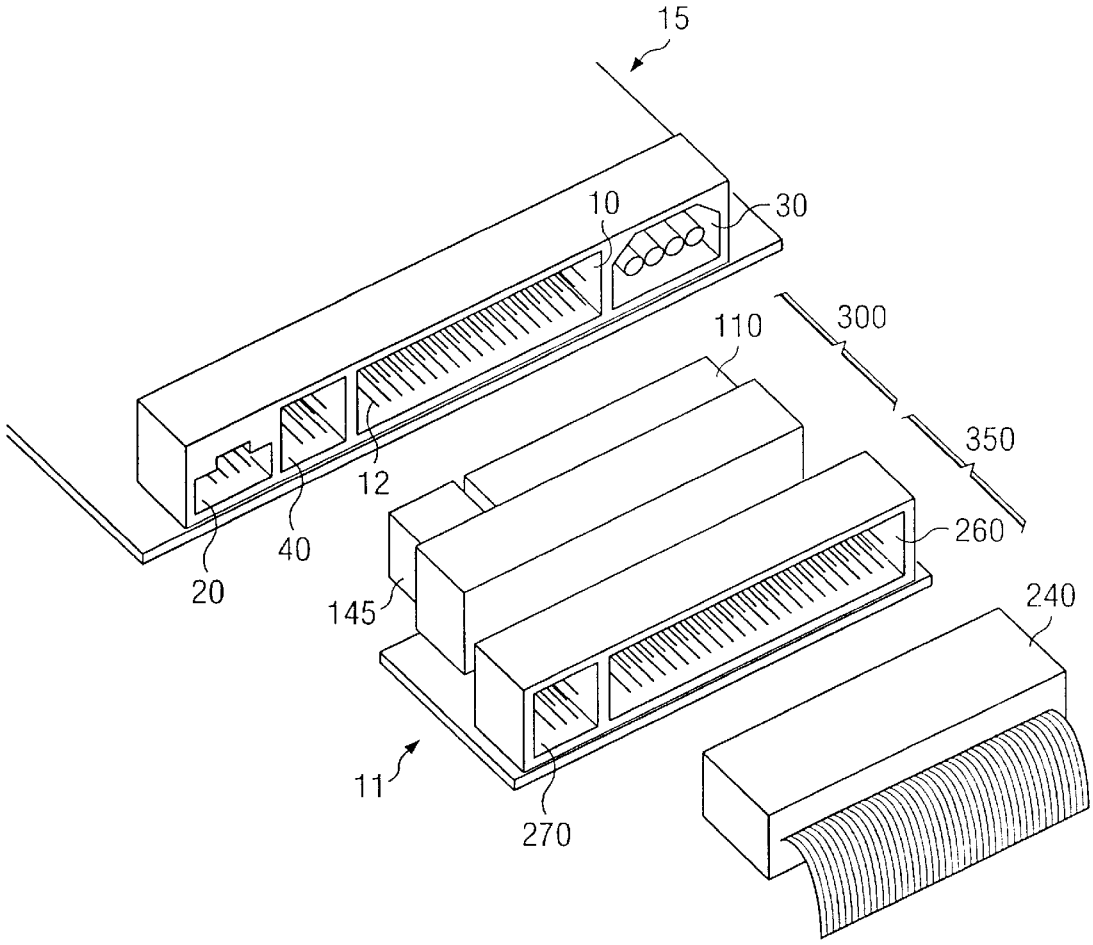
FIG. 2 is a perspective view of another adapter embodying the invention, shown in relation to a computer peripheral device employing a native data interface connector, wherein only a proper subset of all physical interface connections of the device must be converted.

Additionally, not all of the various interfaces required by the device need be converted. For example, as indicated in FIG. 2, if the internal CDROM drive discussed above, with an ATA data interface connector, is to be converted to an internal SCSI configuration using a 50-pin SCSI ribbon cable connector 240, an embodiment of the adapter for this particular case may not contain any connectors that are involved with the audio and power interfaces of the device. Since device audio connector 20 and device power connector 30 on the drive are appropriate for an internal computer peripheral device, no conversion of that hardware need occur. The electrical contacts of ATA device connector 110 are contacted by the interface contacts of ATA data interface connector 10, and the electrical contacts of device configuration connector 145 mate with the configuration contacts of configuration jumper block 40. On the opposite side of the adapter, the signal contacts of a SCSI peripheral interface connector 260 engage the electrical contacts of SCSI ribbon cable connector 240, and a SCSI configuration jumper block 270 is available for configuring the drive for a particular SCSI subsystem. The electrical contacts of device-side connectors 300 and the contacts of computer-side connectors 350 are made as described in the embodiment of FIG. 1.

In another possible device configuration, the device interface hardware to be converted does not necessarily need to contain any connectors for a particular interface to be supported. As displayed in FIG. 3, a CDROM drive of similar capability to that shown in FIG. 1 may implement a single general-purpose connector 200 for all interface types (data, audio, power, and so forth) that are to be implemented. In this particular case, one adapter according to a possible embodiment of the invention must be provided for each data interface to be supported by the device. A particular embodiment of the adapter for this situation implements a single device connector 210 that mates with general-purpose connector 200, with the electrical contacts of device connector 210 engaging the corresponding signal contacts of general-purpose connector 200.

Assuming the device is to be used in an external USB configuration, the set of computer-side connectors 150 will be the same as those of the embodiment of FIG. 1, with the appropriate connections being made between general-purpose device connector 210 and computer-side connectors 150 as discussed above.

Figure 3:
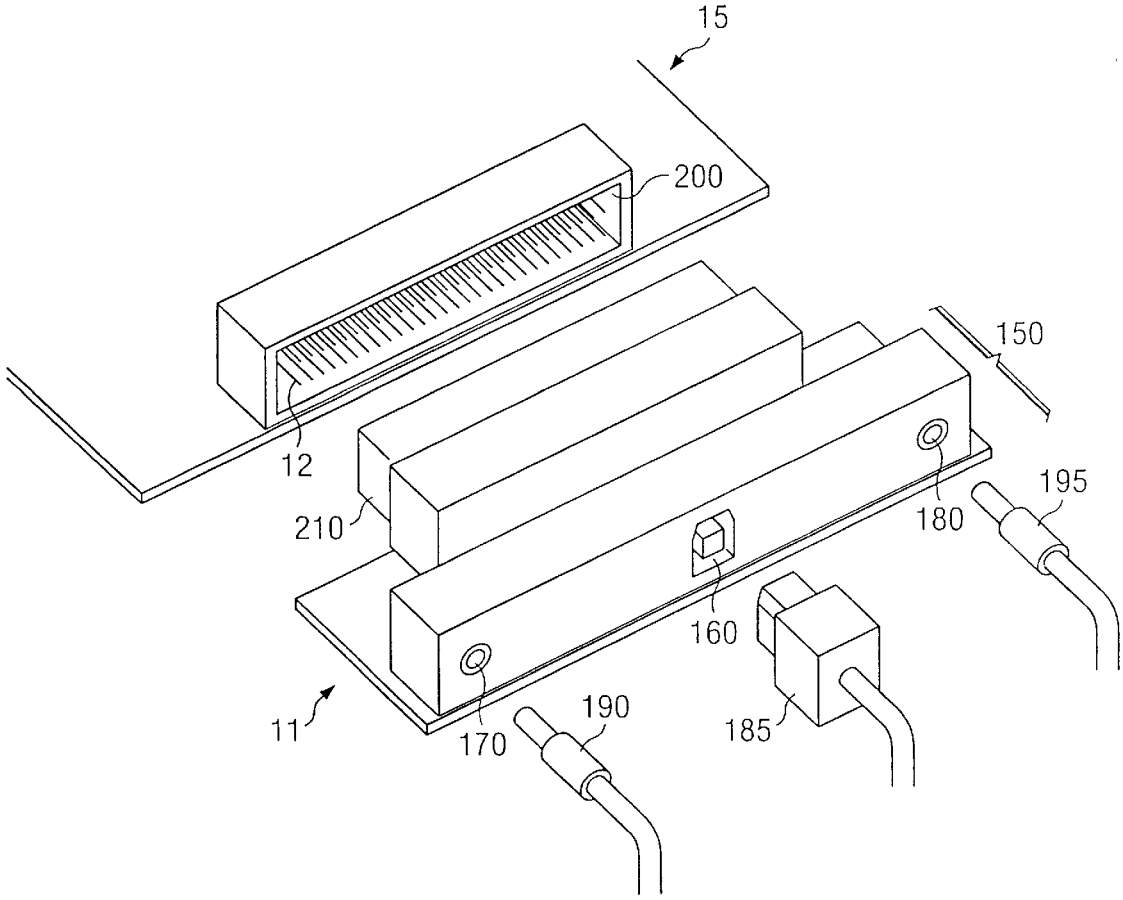
FIG. 3 is a perspective view of another adapter embodying the invention, shown in relation to a computer peripheral device employing a general-purpose connector for interfacing.
Figure 4:
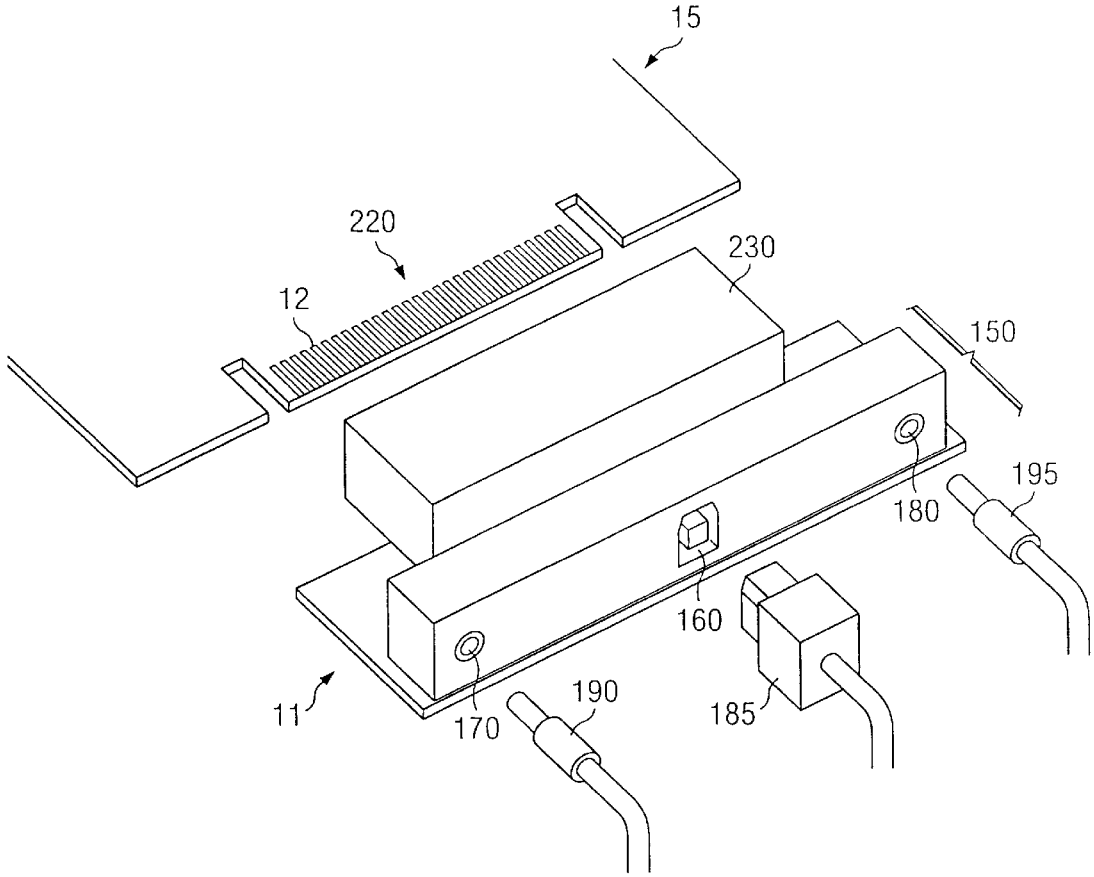
FIG. 4 is a perspective view of another adapter embodying the invention, shown in relation to a computer peripheral device employing a set of conductive pads for interfacing.

In a slightly different device configuration, shown in FIG. 4, the peripheral device may utilize a set of conductive pads 220 arranged on the edge of the main printed circuit board of the device, instead of general-purpose connector 200 from FIG. 3. An adapter according to this embodiment of the invention would use a card-edge device connector 230 to engage conductive pads 220 of the peripheral device. Electrical contacts of card-edge device connector 230 would then be connected, via either wires or printed circuit board traces, to computer-side connectors 150, as has been shown in other embodiments.

Figure 5:
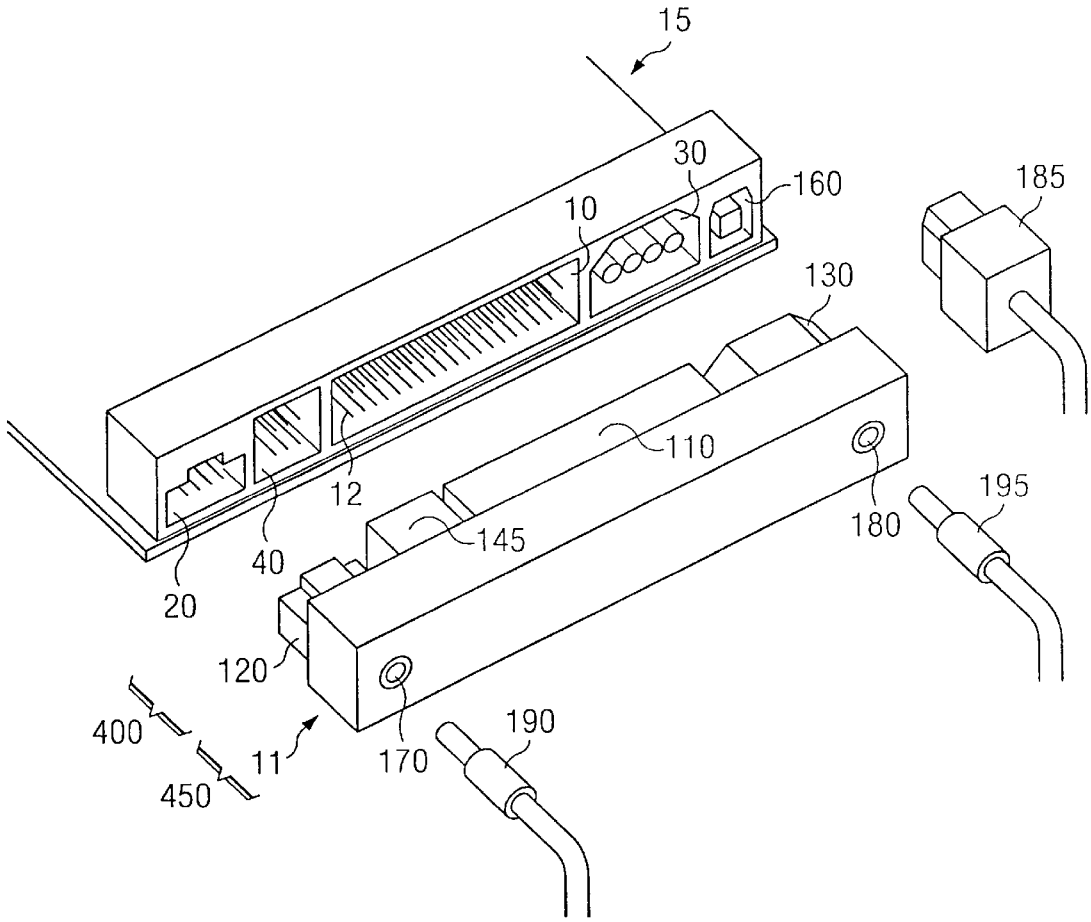
FIG. 5 is a perspective view of another adapter embodying the invention, shown in relation to a computer peripheral device employing the connectors for two separate data interfaces.

In some cases, the data interface connectors for all supported data interfaces are resident on the device. For example, as shown in FIG. 5, a CDROM drive that includes both ATA data interface connector 10 and USB peripheral interface connector 160 could be devised. Also on the device may be audio connector 20, power connector 30, and configuration jumper block 40. To use the device in an internal ATA configuration, no adapter would be necessary, as the data, audio, and power interface connectors would all be appropriate for such a system.

However, if an external USB configuration were desired, USB peripheral interface connector 160 would already be available on the device. However, device audio connector 20 and device power connector 30 would need to be converted to allow the device to be usable in an external environment. To deal with this situation, a possible embodiment of the adapter would contain audio connector 120, the electrical contacts of which would connect with the signal contacts of device audio connector 20, and the electrical contacts of power connector 130 would engage the power contacts of device power connector 30. Also, in a variation of this embodiment, the electrical contacts of ATA device connector 110 may engage the corresponding interface contacts of the ATA data interface connector 10, and the electrical contacts of device configuration connector 145 may mate with the configuration contacts of configuration jumper block 40. Although ATA data interface connector 10 and configuration jumper block 40 do not have to be converted for use as another interface in this instance, a few of the contacts of these connectors could be utilized for the interface indication means, mentioned above and described in greater detail below. The connections required for this function are generally few, requiring much less space than converting between, for example, an internal ATA connector and an internal SCSI connector.

The computer-side connectors 450 would consist of audio interface connector 170, the signal contacts of which mate with the electrical contacts of computer peripheral audio interface connector 190, and the power contacts of power interface connector 180 engage the electrical contacts of computer peripheral power interface connector 195, in a fashion similar to that shown in FIG. 1.

Once again, the electrical conductors of the device-side connectors (400 of FIG. 5) and the signal contacts of the computer side-connectors (450 of FIG. 5) are connected as in the embodiments described above.

In all of the representative embodiments shown above, the adapter must indicate to the device which data interface is to be used during communications with the computer. In a possible embodiment, whereby two data interfaces are supported by the peripheral device, the adapter would contain a connection, or "jumper", between two interface conductors of the device, one of the interface conductors supplying a predetermined voltage to be sensed by the second interface conductor. The presence or absence of the voltage on the second interface conductor would indicate which of the two data interfaces supported by the device would be used.

The identity of these interface conductors would be determined by the nature of the device interface conductors used. For example, in the case where general purpose device connector 210 or card-edge conductive pads 220 are used, as described earlier, any two interface conductors not required for other purposes, such as the data or audio interfaces, could be used for the indication function. For embodiments like those shown in FIG. 1, FIG. 2, and FIG. 5, where the standard interface connectors reside on the device, any conductors of those connectors that are not being utilized for an interfacing function may be used for the indication function. If this is not possible, a small connector with a minimal number of extra conductors could be added to the device for connection with a corresponding connector of the adapter to implement the indication function.

Another possible embodiment may employ the connector contact configuration as found in U.S. Pat. No. 5,741,151 for implementing the indication function using essentially a single interface contact.

Other embodiments of the invention may be created by any method of connecting at least one of the interface conductors of the computer peripheral device to the computer and indicating to the device which of the interfaces supported by the device is to be used.

Although several specific embodiments of the invention have been presented for purposes of illustration, the invention is not to be limited to the embodiments so described. The invention is limited only by the following claims.

What is claimed is:

1. An adapter for connecting a computer peripheral device to a computer, the computer peripheral device having a plurality of interface conductors, the computer peripheral device having the capability of communicating with the computer via any data interface of a plurality of data interfaces supported by the peripheral device, the adapter comprising:

a physical connection converter electrically connecting at least one of the plurality of interface conductors of the computer peripheral device to the computer, the physical connection converter is configured to use a selected data interface of the plurality of supported data interfaces; and an indicator operable to indicate to the computer peripheral device selection of the selected computer peripheral data interface.

2. The adapter of claim 1, wherein the indicator comprises:

an electrical conductor connecting an interface selection contact of the computer peripheral device to one of the plurality of interface conductors that provides a predetermined voltage, the interface selection contact being one of the plurality of interface conductors.

3. The adapter of claim 1, wherein the physical connection converter comprises:

a device connector having a plurality of electrical contacts arranged for connection with a plurality of interface contacts of a data interface connector of the computer peripheral device, the interface contacts of the data interface connector comprising at least one of the plurality of interface conductors;

a peripheral interface connector having a plurality of signal contacts arranged for connection to a plurality of electrical contacts of a computer interface connector of the computer; and a plurality of connections operably extending from the electrical contacts of the device connector to the signal contacts of the peripheral interface connector.

4. The adapter of claim 3, further comprising:

an audio connector having a plurality of electrical contacts arranged for connection with a plurality of signal contacts of a device audio connector of the computer peripheral device, the signal contacts of the device audio connector comprising at least one of the plurality of interface conductors;

an audio interface connector having a plurality of signal contacts arranged for connection with a plurality of electrical contacts of a computer peripheral audio interface connector associated with the indicated computer peripheral data interface; and at least one audio connection operably extending from the electrical contacts of the audio connector to the signal contacts of the audio interface connector.

5. The adapter of claim 3, further comprising:

a power connector having a plurality of electrical contacts arranged for connection with a plurality of power contacts of a device power connector of the computer peripheral device, the power contacts of the device power connector comprising at least one of the plurality of interface conductors;

a power interface connector having a plurality of power contacts arranged for connection with a plurality of electrical contacts of a computer peripheral power interface connector associated with the indicated computer peripheral data interface; and at least one power connection operably extending from the electrical contacts of the power connector to the power contacts of the power interface connector.

6. The adapter of claim 3, wherein the plurality of connections comprise electrically conductive traces on a printed circuit board.

7. The adapter of claim 3, wherein the plurality of connections comprise flexible wires.

8. The adapter of claim 1, wherein the physical connection converter comprises:

a device connector having a plurality of electrical contacts arranged for connection with a plurality of signal contacts of a general-purpose connector on the computer peripheral device, the signal contacts of the general-purpose connector being connected to a plurality of internal signal lines to be used for the indicated computer peripheral data interface, the signal contacts of the general-purpose connector comprising at least one of the plurality of interface conductors;

a peripheral interface connector having a plurality of signal contacts arranged for connection to a plurality of electrical contacts of a computer peripheral data interface connector, the electrical contacts of the computer peripheral data interface connector being connected to the indicated computer peripheral data interface of the computer; and a plurality of connections operably extending from the electrical contacts of the device connector to the signal contacts of the peripheral interface connector.

9. The adapter of claim 8, further comprising:

an audio interface connector having a plurality of signal contacts arranged for connection with a plurality of electrical contacts of a computer peripheral audio interface connector associated with the indicated computer peripheral data interface;

the device connector includes a plurality of audio signal contacts arranged for connection with the signal contacts of the general-purpose connector that are associated with an audio interface of the computer peripheral device; and at least one audio connection operably extending from the audio signal contacts of the device connector to the signal contacts of the audio interface connector.

10. The adapter of claim 8, further comprising:

a power interface connector having a plurality of power contacts arranged for connection with a plurality of electrical contacts of a computer peripheral power interface connector associated with the indicated computer peripheral data interface;

the device connector includes a plurality of power contacts arranged for connection with the signal contacts of the general-purpose connector that are associated with a power interface of the computer peripheral device; and at least one power connection operably extending from the power contacts of the device connector to the power contacts of the power interface connector.

11. The adapter of claim 8, wherein the plurality of connections comprise electrically conductive traces on a printed circuit board.

12. The adapter of claim 8, wherein the plurality of connections comprise flexible wires.

13. The adapter of claim 1, wherein the physical connection converter comprises:

a device connector having a plurality of electrical contacts arranged for connection with a plurality of electrically conductive pads of a printed circuit board of the computer peripheral device, the conductive pads being connected to a plurality of internal signal lines to be used for the indicated computer peripheral data interface, the conductive pads comprising at least one of the plurality of interface conductors;

a peripheral interface connector having a plurality of signal contacts arranged for connection with a plurality of electrical contacts of a computer peripheral data interface connector, the electrical contacts of the computer peripheral data interface being connected to the indicated computer peripheral data interface of the computer; and a plurality of connections operably extending from the electrical contacts of the device connector to the signal contacts of the peripheral interface connector.

14. The adapter of claim 13, further comprising:

an audio interface connector having a plurality of signal contacts arranged for connection with a plurality of electrical contacts of a computer peripheral audio interface connector associated with the indicated computer peripheral data interface;

the device connector includes a plurality of audio signal contacts arranged for connection with electrically conductive pads of the printed circuit board that are associated with an audio interface of the computer peripheral device; and at least one audio connection operably extending from the audio signal contacts of the device connector to the signal contacts of the audio interface connector.

15. The adapter of claim 13, further comprising:

a power interface connector having a plurality of power contacts arranged for connection with a plurality of electrical contacts of a computer peripheral power interface connector associated with the indicated computer peripheral data interface;

the device connector includes a plurality of power contacts arranged for connection with electrically conductive pads of the printed circuit board that are associated with a power interface of the computer peripheral device; and at least one power connection operably extending from the power contacts of the device connector to the power contacts of the power interface connector.

16. The adapter of claim 13, wherein the plurality of connections comprise electrically conductive traces on a printed circuit board.

17. The adapter of claim 13, wherein the plurality of connections comprise flexible wires.

18. The adapter of claim 1, wherein the physical connection converter comprises:

an audio connector having a plurality of electrical contacts arranged for connection with a plurality of audio signal contacts of a device audio connector on the computer peripheral device, the audio signal contacts of the device audio connector comprising at least one of the plurality of the interface conductors;

an audio interface connector having a plurality of signal contacts arranged for connection with a plurality of electrical contacts of a computer peripheral audio interface connector associated with the indicated computer peripheral data interface;

at least one audio connection operably extending from the electrical contacts of the audio connector to the signal contacts of the audio interface connector;

a power connector having a plurality of electrical contacts arranged for connection with power contacts of a device power connector on the computer peripheral device, the power contacts of the device power connector comprising at least one of the plurality of the interface conductors;

a power interface connector having a plurality of power contacts arranged for connection with a plurality of power contacts of a computer peripheral power interface connector associated with the indicated computer peripheral data interface; and at least one power connection operably extending from the electrical contacts of the power connector to the power contacts of the power interface connector.

19. A method for connecting a computer peripheral device to a computer, the computer peripheral device having a plurality of interface conductors, the computer peripheral device having the capability of communicating with the computer via any data interface of a plurality of data interfaces supported by the peripheral device, the method comprising the steps of:

electrically connecting at least one of the plurality of interface conductors of the computer peripheral device to the computer using a physical connection converter; and indicating to the computer peripheral device, using the physical connection converter, selection of a selected data interface of the plurality of supported data interfaces.

20. The method of claim 19 further comprising the steps of:

connecting an audio connector of the computer peripheral device to the computer; and connecting a power connector of the computer peripheral device to a power supply of the computer.

* * * * *